US010137560B2

(12) United States Patent
Bullard

(10) Patent No.: US 10,137,560 B2
(45) Date of Patent: Nov. 27, 2018

(54) JEWELRY MANDREL PLIERS AND METHOD OF USING SAME

(71) Applicant: Wubbers, LLC, Lubbock, TX (US)

(72) Inventor: Patricia Bullard, Lubbock, TX (US)

(73) Assignee: Wubbers, LLC, South Lake, TX (US)

( * ) Notice: Subject to any disclaimer, the term of this patent is extended or adjusted under 35 U.S.C. 154(b) by 0 days.

(21) Appl. No.: 15/616,894

(22) Filed: Jun. 7, 2017

(65) Prior Publication Data

US 2017/0266785 A1 Sep. 21, 2017

Related U.S. Application Data

(63) Continuation-in-part of application No. 14/985,781, filed on Dec. 31, 2015, now Pat. No. 9,687,966, (Continued)

(51) Int. Cl.

| | |
|---|---|
| ***B25B 7/02*** | (2006.01) |
| ***B21F 1/00*** | (2006.01) |
| ***B21D 53/44*** | (2006.01) |
| ***B25B 7/08*** | (2006.01) |
| ***B25B 7/12*** | (2006.01) |
| *B21D 11/06* | (2006.01) |

(52) U.S. Cl.

CPC ..... *B25B 7/02* (2013.01); *B21D 53/44* (2013.01); *B21F 1/002* (2013.01); *B25B 7/08* (2013.01); *B25B 7/12* (2013.01); *B21D 11/06* (2013.01)

(58) Field of Classification Search

CPC .. B21F 1/002; B21F 1/06; B21F 15/04; B25B 7/02; A44C 27/00

See application file for complete search history.

(56) References Cited

U.S. PATENT DOCUMENTS

| | | | |
|---|---|---|---|
| 399,655 | A | 3/1889 | Daniels |
| 401,004 | A | 4/1889 | Campbell |

(Continued)

FOREIGN PATENT DOCUMENTS

| | | |
|---|---|---|
| DE | 202009008237 | 10/2009 |
| FR | 712630 | 10/1931 |
| JP | 2000334667 A | 12/2000 |

OTHER PUBLICATIONS

Australian Patent Examination Report, Australian Application Serial No. 2012267528, dated Jan. 15, 2015, 2 pages.

(Continued)

*Primary Examiner* — Debra Sullivan

(74) *Attorney, Agent, or Firm* — Vincent J. Allen; Carstens & Cahoon, LLP

(57) ABSTRACT

The present invention provides a mandrel tool and method for more efficiently and consistently forming various shapes of material. In one embodiment of the invention, a pair of pliers having mandrel jaws that are shaped with a uniform cross sectional area throughout a length of the mandrel jaw is used to replace the traditional tapered mandrel. Because the mandrel jaws have a uniform cross sectional area, the wire, for example, can be wrapped multiple times around the mandrel jaw when it is desired to produce multiples of the same shape. For added versatility, the pliers can have opposing mandrel jaws, with different size cross sectional area.

44 Claims, 13 Drawing Sheets

Related U.S. Application Data which is a continuation of application No. 13/491,755, filed on Jun. 8, 2012, now Pat. No. 9,227,304.

(60) Provisional application No. 61/494,705, filed on Jun. 8, 2011.

(56) References Cited

U.S. PATENT DOCUMENTS

| | | | | |
|---|---|---|---|---|
| 429,961 | A | | 6/1890 | Robbins |
| 652,359 | A | | 6/1900 | Haigh et al. |
| 995,754 | A | | 6/1911 | Young |
| 1,268,922 | A | | 6/1918 | Bryan |
| 1,337,616 | A | | 4/1920 | Olhovsky |
| 1,517,302 | A | * | 12/1924 | McNerney ..... B25B 7/02 81/341 |
| 1,519,550 | A | | 12/1924 | Pozgay |
| 1,666,801 | A | | 4/1928 | Varney |
| 2,485,459 | A | | 10/1949 | Rackowski |
| 2,500,327 | A | | 3/1950 | Smith |
| 2,507,784 | A | | 5/1950 | Hamel |
| 2,757,800 | A | | 11/1951 | Eicher |
| 2,677,293 | A | | 5/1954 | Kohler |
| 2,824,583 | A | | 2/1958 | Knoester |
| 2,826,106 | A | | 3/1958 | Schegulla |
| 3,221,779 | A | | 12/1965 | Noel |
| 3,861,430 | A | | 1/1975 | Story |
| 3,956,950 | A | | 5/1976 | Jamell |
| 4,245,377 | A | | 1/1981 | Soltes |
| 4,331,183 | A | | 5/1982 | Calhoun |
| 4,423,757 | A | | 1/1984 | Broberg |
| 4,539,873 | A | | 9/1985 | Freed |
| 5,084,935 | A | | 2/1992 | Kalthoff |
| 5,213,139 | A | * | 5/1993 | Deuel ..... B21F 1/002 140/147 |
| 5,426,843 | A | | 6/1995 | Bartky |
| 5,513,513 | A | | 5/1996 | Suess et al. |
| 5,520,227 | A | | 5/1996 | Kelley |
| 5,632,086 | A | | 5/1997 | Helwig |
| 5,878,788 | A | | 3/1999 | Gurry |
| 5,927,059 | A | | 7/1999 | Goertz |
| 5,966,811 | A | | 10/1999 | Zalusky |
| 6,253,798 | B1 | | 7/2001 | Helwig |
| 6,321,519 | B1 | | 11/2001 | Goertz |
| 7,032,627 | B1 | | 4/2006 | Sheriff |
| 7,322,119 | B2 | | 1/2008 | Haug |
| 7,343,939 | B1 | | 3/2008 | Sheriff |
| 7,814,817 | B1 | | 10/2010 | Sheriff |
| 8,176,814 | B1 | | 5/2012 | Bemstien et al. |
| 2009/0188092 | A1 | | 7/2009 | Teresiak |
| 2010/0108964 | A1 | | 5/2010 | Clark et al. |
| 2010/0288085 | A1 | | 11/2010 | Carter |
| 2011/0303319 | A1 | | 12/2011 | Bullard |

OTHER PUBLICATIONS

International Search Report and Written Opinion for PCT Application Serial No. PCT/US12/041719, dated Feb. 14, 2013, 10 pages.
The Answer Man, Lapidary Journal Tools & Supplies, Jul. 2002, lapidaryjoumal.com, 3 pages.
EP Supplemental Search Report, Application Serial No. 12796805, dated Aug. 7, 2015, 6 pages.

* cited by examiner

JEWELRY MANDREL PLIERS AND METHOD OF USING SAME

CROSS-REFERENCE TO RELATED APPLICATIONS

This application is a continuation-in-part of U.S. Nonprovisional application Ser. No. 14/985,781, filed Dec. 31, 2015, which is itself a continuation of U.S. Nonprovisional application Ser. No. 13/491,755, filed Jun. 8, 2012, and claims the benefit of U.S. Provisional Application No. 61/494,705, filed Jun. 8, 2011, which are all incorporated by reference in their entirety as examples.

BACKGROUND OF THE INVENTION

Technical Field

The present invention relates to a tool for manufacturing jewelry and a method of using such tool. More particularly, this invention relates to a jewelry mandrel constructed in the form of pliers and method, which can be used by jewelers to fabricate jewelry into various shapes.

Description of Related Art

Jewelers have long relied on tapered steel mandrels to fabricate wire or metal shapes for use in their jewelry designs. Tapered mandrels are available in cross sections of various shapes including round, square, triangle, oval, and hexagon. The mandrels are made of steel and provide a surface against which the jeweler can hammer to facilitate the shaping of the material being worked. The taper on the mandrel allows shapes of different sizes to be fabricated using a single mandrel. Although tapered steel mandrels are useful for certain tasks, they present the jeweler with challenges.

The taper on the mandrel makes it difficult to make shapes of the exact size when multiple items are being produced. The reason for this is that the circumference of the particular shape at issue has a tendency to stretch as it is worked on a tapered mandrel, particularly when working with wire. When making multiple items of the same size, each item must be formed one at time when it is made using a tapered mandrel. Because of the difficulty in placing the material in the exact same place on the tapered mandrel while hammering it into shape, the resulting shapes are often of a slightly different size.

To form a band from a strip of metal using a tapered mandrel, the band must frequently be removed and flipped so that the band does not become larger on one side than the other. The wider a particular band, the more difficult it becomes to keep both edges of the band the same size.

Moreover although a tapered mandrel can be used to produce a shape with sharp corners such a triangle or a square, it is not an easy task. The jeweler must first start with a closed ring or loop and then hammer it down around the mandrel until it produces a sharply defined shape. However, hammering a piece of soft wire or metal on a tapered mandrel often results in the shape being stretched beyond the circumference desired.

Finally, a tapered mandrel is awkward and is difficult to hold by hand. It can be placed in a large vise to hold it, but this method is time consuming and inconvenient. The vise also makes it difficult to obtain a good view of the entire piece in that the mandrel would need to be removed from the vise and rotated to obtain a good view of the back side of the mandrel.

It is therefore an object of the invention to provide a jewelry mandrel tool and method of using same that enables a user to easily, consistently, and repeatedly replicate the same shape and size. It is also an object of the invention to provide a tool for making numerous rings or other shapes in a more efficient manner and to provide a tool that makes it easier for the jeweler to view the work as it is being formed. It is an object of the invention to provide a tool that allows the wire or metal being formed to be gripped so that shapes can be made without the need for starting with a closed metal ring or tube.

SUMMARY OF AN EMBODIMENT OF INVENTION

The present invention provides a mandrel tool and method for more efficiently and consistently forming various shapes of material. In one embodiment of the invention, a pair of pliers having mandrel jaws that are shaped with a uniform cross sectional area throughout a length of the mandrel jaw is used to replace the traditional tapered mandrel. The mandrel pliers of the present invention may be used to grip wire or sheet metal and form it into unique shapes such as squares, triangles, ovals, or circles. Because the mandrel jaws have a uniform cross sectional area, the wire, for example, can be wrapped multiple times around the mandrel jaw when it is desired to produce multiples of the same shape. For added versatility, the pliers can have opposing mandrel jaws, each having a different size cross sectional area than the other so that a shape of a larger size can be created on one side of the pair pliers and a shape of a smaller size can be reproduced on the other side of the pair of pliers.

DETAILED DESCRIPTION

Figure 1:
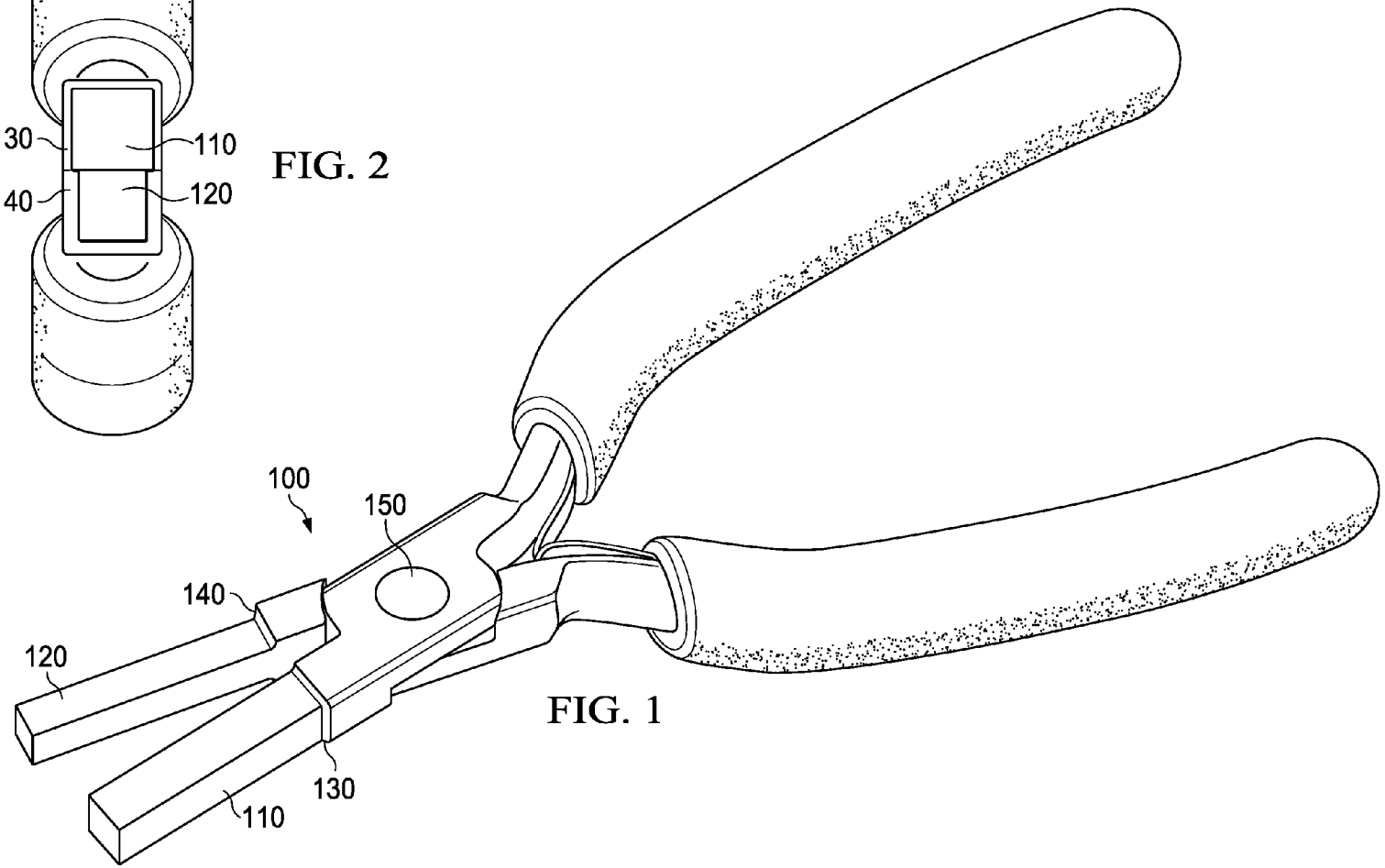
FIG. 1 is a perspective view of a pair of mandrel pliers in accordance with an embodiment of the present invention.

Referring now to FIG. 1, a perspective view of a pair of mandrel pliers in accordance with an embodiment of present is invention is illustrated. The pliers 100 have mandrel jaws 110, 120, each having a uniform square cross sectional area along a length from the tip of the mandrel jaw to the raised areas 130, 140 that are near the pivot 150 of the pliers 100. To allow more versatility for the pliers 100 and to require fewer pliers to be purchased by the jeweler to manufacture shapes of various sizes, the mandrel jaws 110, 120 can be constructed of different dimensions. As illustrated, the cross sectional area of the mandrel jaw 110 is larger than the cross sectional area of the opposing mandrel jaw 120.

Figure 2:
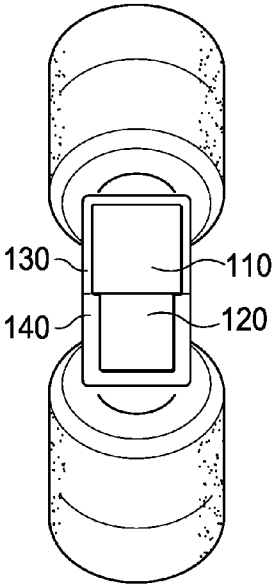
FIG. 2 is an end view of a pair of mandrel pliers in accordance with an embodiment of the present invention.
Figure 3:
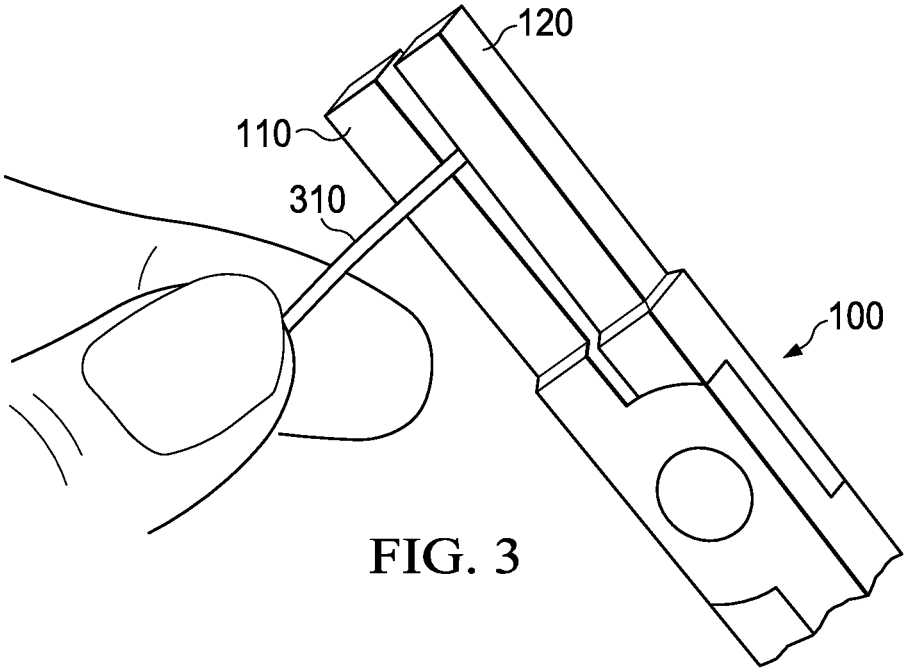
FIGS. 3-7 illustrate a method of using a pair of mandrel pliers to make a square jump ring in accordance with an embodiment of the invention.

Referring now to FIG. 2, an end view of a pair of mandrel pliers in accordance with an embodiment of the present invention is illustrated. The upper mandrel jaw 110 has a larger cross sectional area than the lower mandrel jaw 120.

Although mandrel jaws 110, 120 are illustrated in the form of square mandrels, various shapes can be utilized for the mandrel jaw 110, 120 without departing from the spirit and scope of the invention. For example, the mandrel jaws could be triangular, round, oval, rectangular, or any other shape that is desired by a jeweler for shaping jewelry. Additionally, the opposing jaws could each be a different shape. For example, one jaw could have a triangular cross section and the other jaw could have a square cross section.

Figure 4:
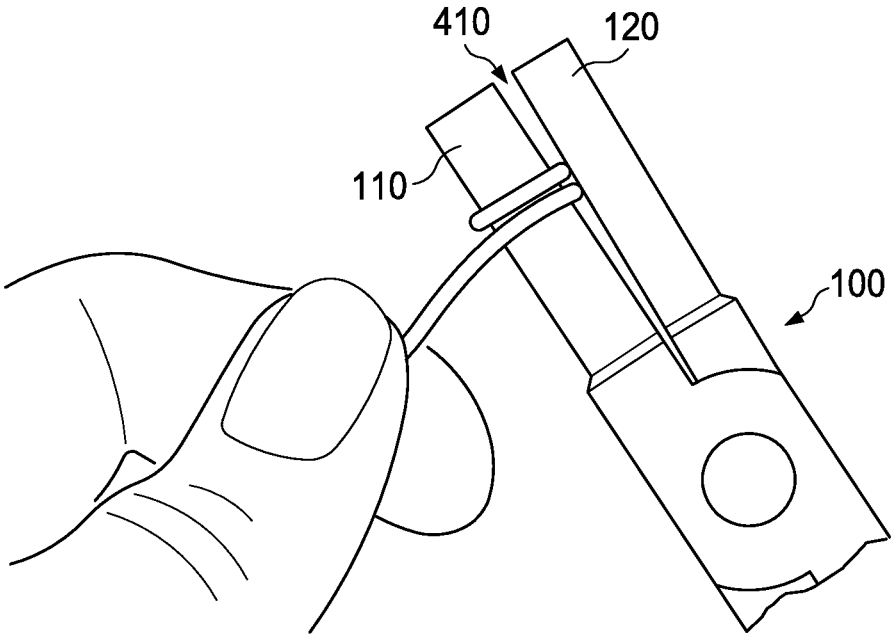
Figure 5:
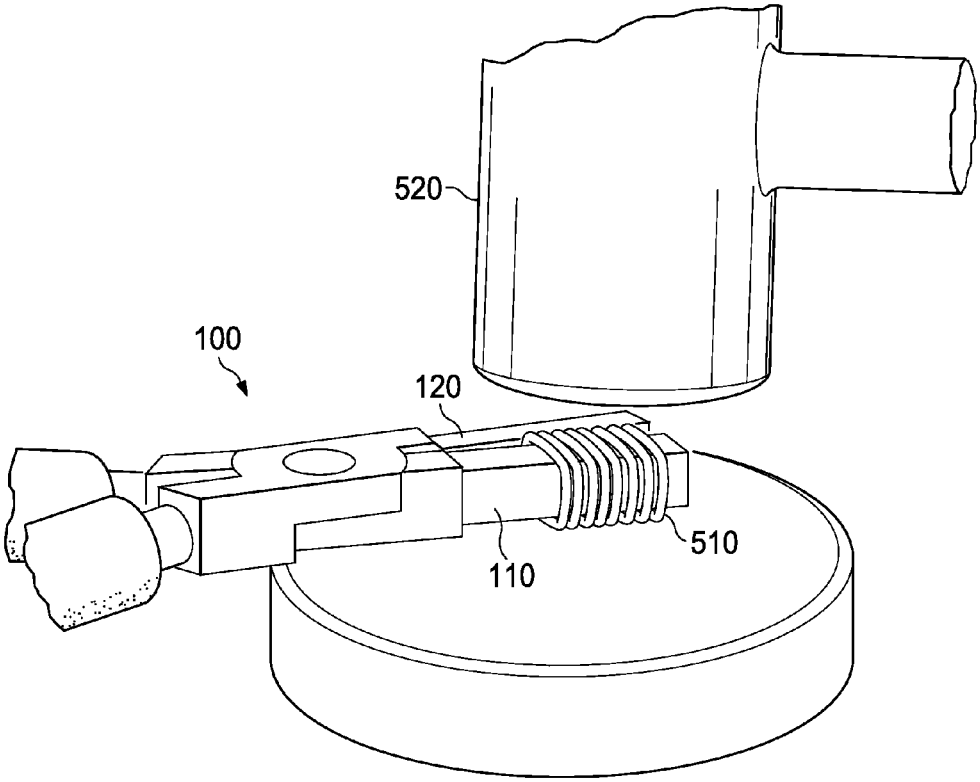
Figure 6:
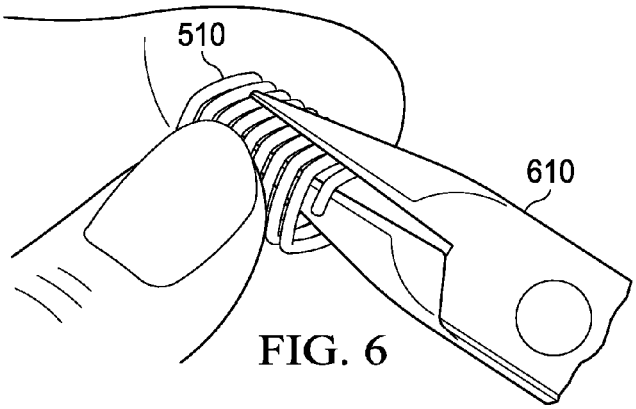
Figure 7:
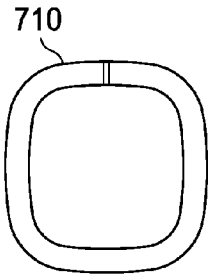

Referring now to FIGS. 3-7, a method of using the mandrel pliers 100 to make a square jump ring in accordance with an embodiment of the invention is illustrated. To make square jump rings (or links) with the pliers 100, the wire 310 is placed between the mandrel jaws 110, 120 and gripped firmly as the user wraps the wire 310 around the outside of the mandrel jaw 110 while pulling tightly on the wire 310. Once the wire is wrapped around to the opposing side of the mandrel pliers 100 the mandrel jaws 110, 120 are then opened by the user to allow the user to continue wrapping the wire around the mandrel jaw 110. Once the wire is placed through the space 410 between the mandrel jaws 110, 120, the user re-grips the wire and repeats the process pulling the wire tightly around the mandrel jaw 110 again as shown in FIG. 4. This process is continued until the desired number of wraps is reached. The bends of the coil 510 at the corners of the mandrel jaw 110 can be sharpened by hammering the three exposed sides of the coil directly onto the mandrel jaw 110 with a hammer 520 as shown in FIG. 5. After forming, the coil 510 is slid off of the mandrel jaw 110. The coil 510 can be used as is to make jewelry or the coil can be cut as shown in FIG. 6 to produce a square jump ring 710 as shown in FIG. 7.

Figure 8:
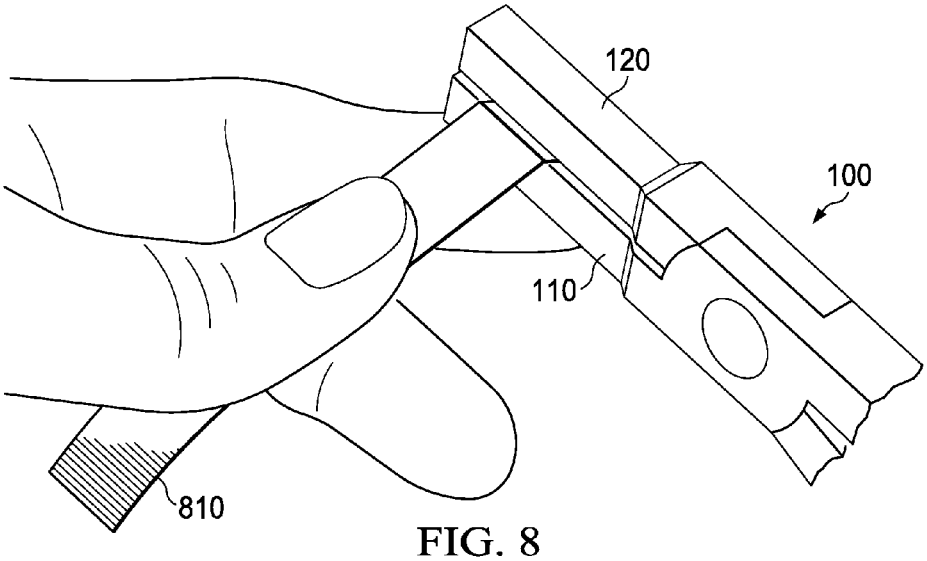
FIGS. 8-10 illustrate a method of using a pair of mandrel pliers to make a square tube in accordance with an embodiment of the invention.
Figure 9:
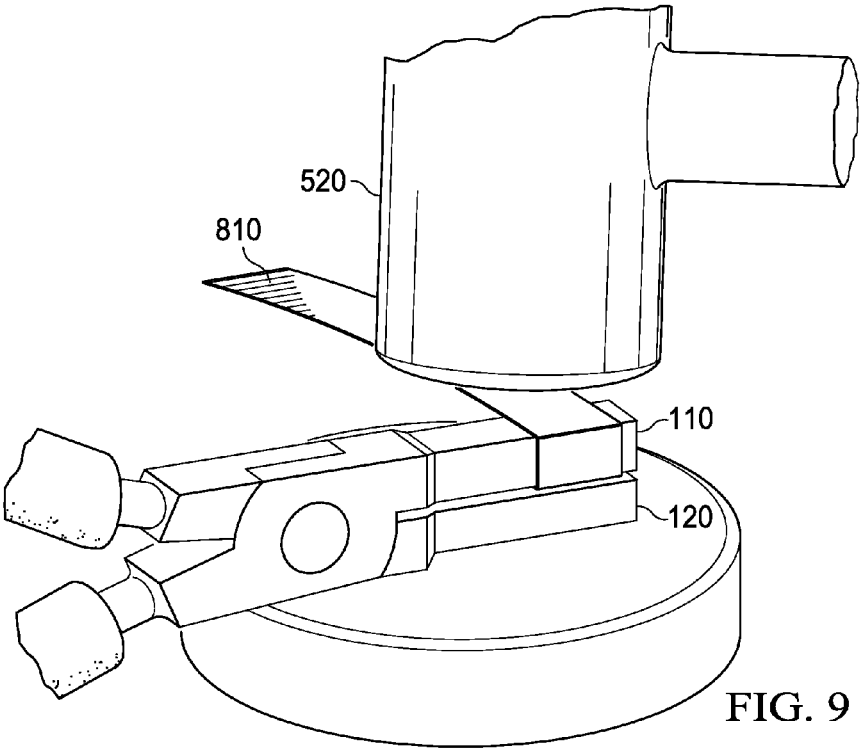
Figure 10:
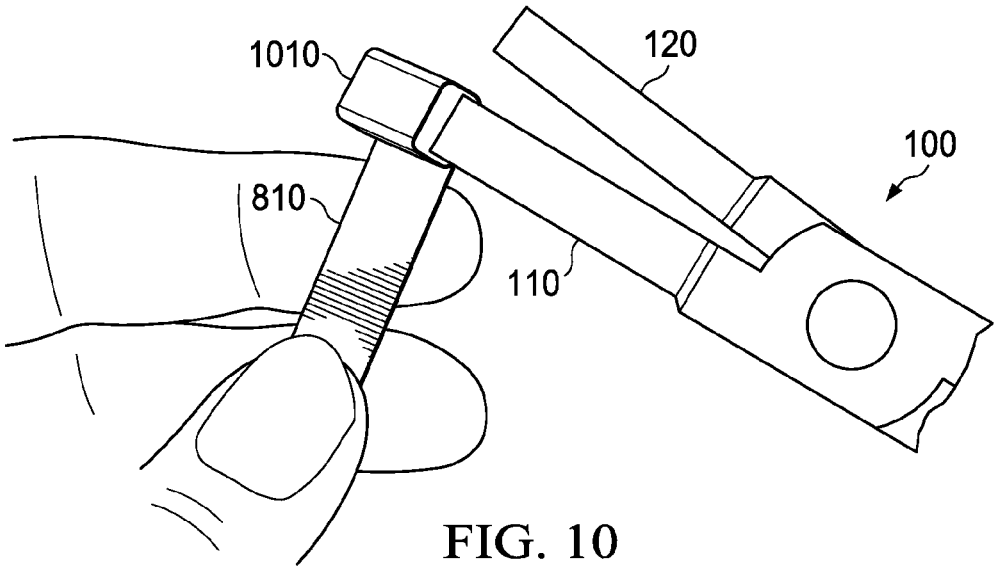

Referring now to FIGS. 8-10, a method of using the mandrel pliers 100 to make a square tube in accordance with an embodiment of the invention is illustrated. To make a square tube with the pliers 100, a strip of sheet metal 810 is placed between the mandrel jaws 110, 120 and gripped firmly as the user wraps the strip of sheet metal 810 around the outside of the mandrel jaw 110 while pulling tightly on the sheet metal 810. Depending on the thickness and flexibility of the sheet metal 810, it may be desirable to square each corner off more precisely by hammering directly on the mandrel jaw of the pliers after each bend as shown in FIG. 9. Once the formation of the sheet metal is completed, the square tube 1010 can be slid off the mandrel jaw 110 as shown in FIG. 10. The excess sheet metal 810 can then be trimmed adjacent to the square tube 1010. To complete the square tube, the joint may be soldered as is known in the art.

Figure 11:
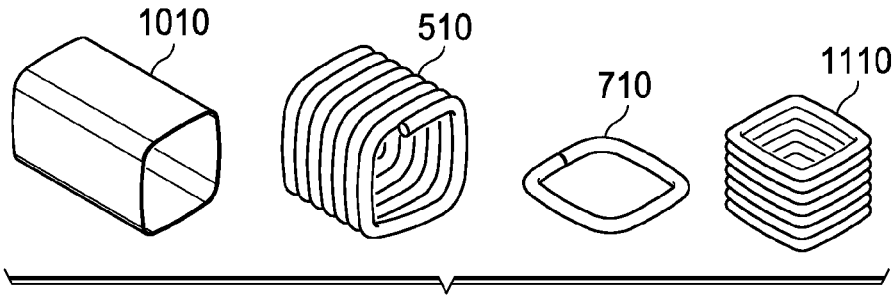
FIG. 11 is a perspective view of some examples of shapes that can be made using an embodiment of the mandrel pliers and method of the present invention.

Referring now to FIG. 11, some examples of shapes that can be made using the method of the present invention are illustrated. These shapes have many applications for a jewelry designer. The tubes can be soldered together to make big-hole beads or the jeweler can make bezels for setting stones or holding resin. A disk can also be soldered to each end of the tube to create matching hollow beads. The square coils can be linked together, fused, or soldered to make a fancy tube 1110. As previously discussed, the square coils can also be cut to make jump rings or links that can be flattened and textured with hammers.

Figure 12:
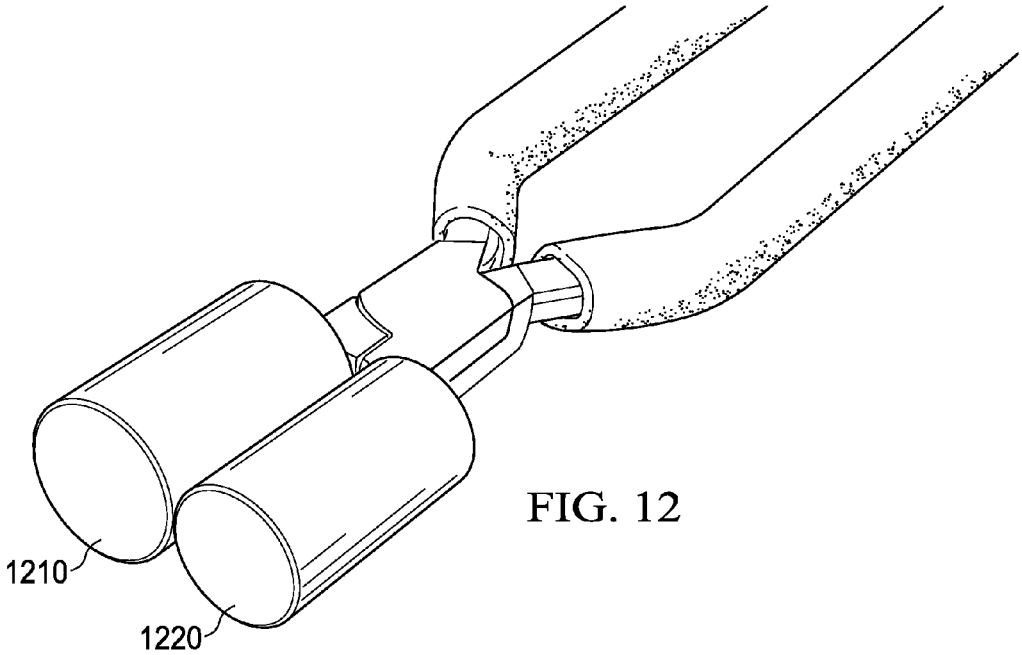
FIGS. 12-13 illustrate perspective views of mandrel pliers with oversized mandrel jaws.
Figure 13:
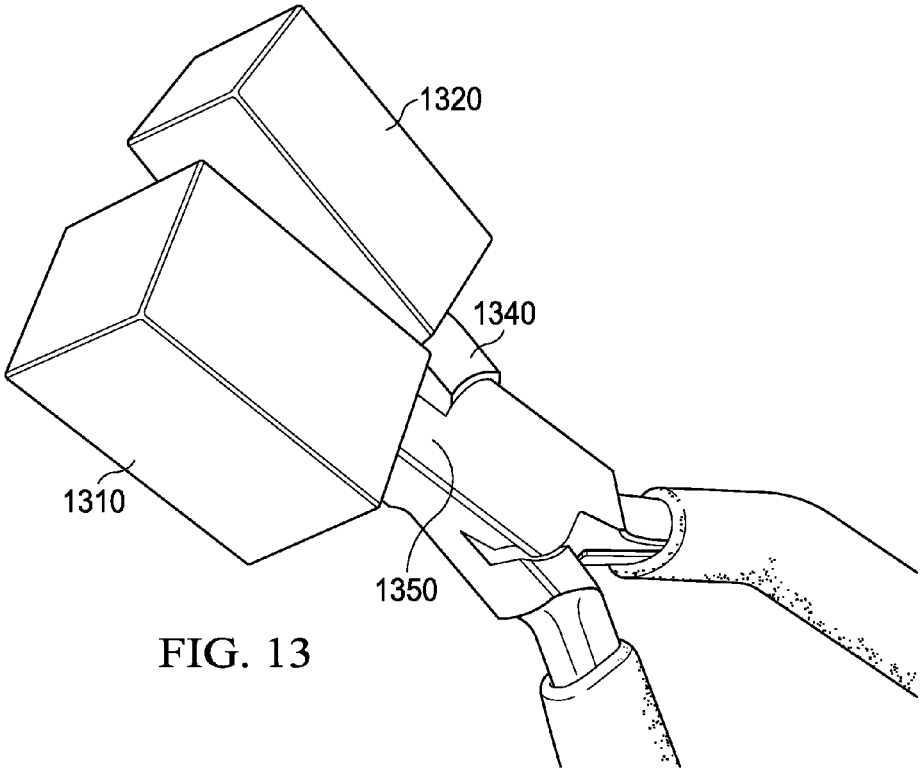

Referring now to FIGS. 12 and 13, perspective views of mandrel pliers with oversized mandrel jaws is illustrated. The pliers of FIG. 12 have oversized cylindrical jaws 1210, 1220. The jaws each have a different cross-sectional area to allow circular shapes of different sizes to be formed. Similarly, the pliers of FIG. 13 have oversized cylindrical jaws 1210, 1220. The jaws each have a different cross-sectional area to allow circular shapes of different sizes to be formed. Pliers with oversized jaws can be constructed by first forming the desired mandrel jaws 1320, 1310 and then welding the mandrel jaws to the ends 1340, 1350 of the plier handle assembly. The pliers of FIG. 1 can be formed by machining the mandrel jaws 110, 120 and one half of the plier assembly from a single piece of stock. Because of the large size of the mandrel jaws of the pliers illustrated in FIGS. 12 and 13, welding of the mandrel jaws to the plier assembly may be a more efficient method of manufacturing the pliers than machining would be.

Figure 14:
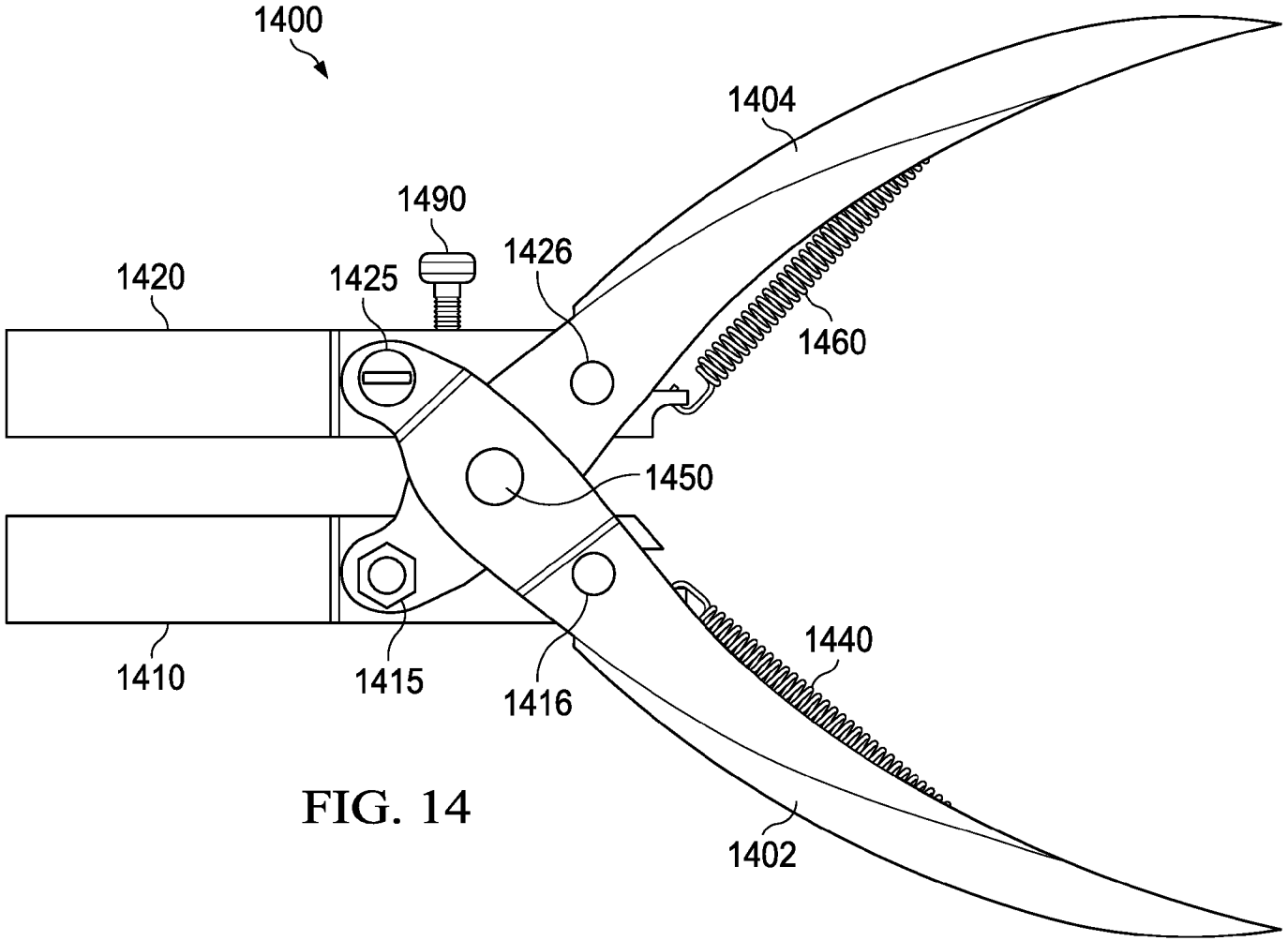
FIG. 14 is a side view of a pair of parallel-action mandrel pliers in accordance with an illustrative embodiment.

FIG. 14 is a side view of a pair of parallel-action mandrel pliers in accordance with an illustrative embodiment. The parallel-action mandrel pliers 1400 have a compound pivoting mechanism that permits the two mandrel jaws to maintain a parallel or at least a substantially parallel orientation as they move from an open configuration to a closed configuration. As a result, each of a plurality of wire loops formed by wrapping a wire around one of the mandrel jaws will be subjected to the same grasping force. In contrast, when a plurality of wire loops are grasped by a pair of pliers with mandrel jaws that travel in an arced path relative to each other, the wire loop closest to the connection point is grasped with the most amount of force and wire loops furthest from the connection point are grasped with the least amount of force, or not at all. The differential grasping forces may result in marring of the wire, or wire loops that lack consistent sizes.

Returning to FIG. 14, the pair of parallel-action mandrel pliers 1400 may be generally described as a pair of substantially parallel mandrel jaws 1410 and 1420, each of which are connected to each of a pair of handles 1402 and 1404. Further, the pair of handles 1402 and 1404 are connected to each other at a pivot 1450 so that application of a squeezing force on the pair of handles 1402 and 1404 causes the mandrel jaws 1410 and 1420 to achieve a closed configuration, but while keeping the mandrel jaws 1410 and 1420 in a parallel configuration. The pivot 1450 may be a connector that connects the handles 1402 and 1404 from the front side to the back side of the handles 1402 and 1404, or the pivot 1450 may be two connectors: one connector coupling one side of handles 1402 and 1404, another connector coupling the other side of handles 1402 and 1404, and a space separating one side of handles 1402 and 1404 from the other side of handles 1402 and 1404.

As mentioned previously, although mandrel jaws 1410 and 1420 are illustrated in the form of square mandrels, various shapes can be utilized for the mandrel jaw 1410 and 1420 without departing from the spirit and scope of the invention. For example, the mandrel jaws could be triangular, round, oval, rectangular, or any other shape that is desired by a jeweler for shaping jewelry. Additionally, the opposing jaws could each be a different shape. For example, one jaw could have a triangular cross section and the other jaw could have a square cross section. Additionally, the mandrel pliers 1400 are not limited to mandrel jaws of the same size or shape, or any combination thereof. For example, one pair of parallel action mandrel pliers may have rectangular mandrel jaws, with each jaw being the exact same size and shape, and another pair may have one mandrel that is rectangular and the other mandrel that is triangular and a smaller size than that of the rectangular mandrel. The present invention is not limited to any combination of size or shape of the mandrel jaws.

Figure 16:
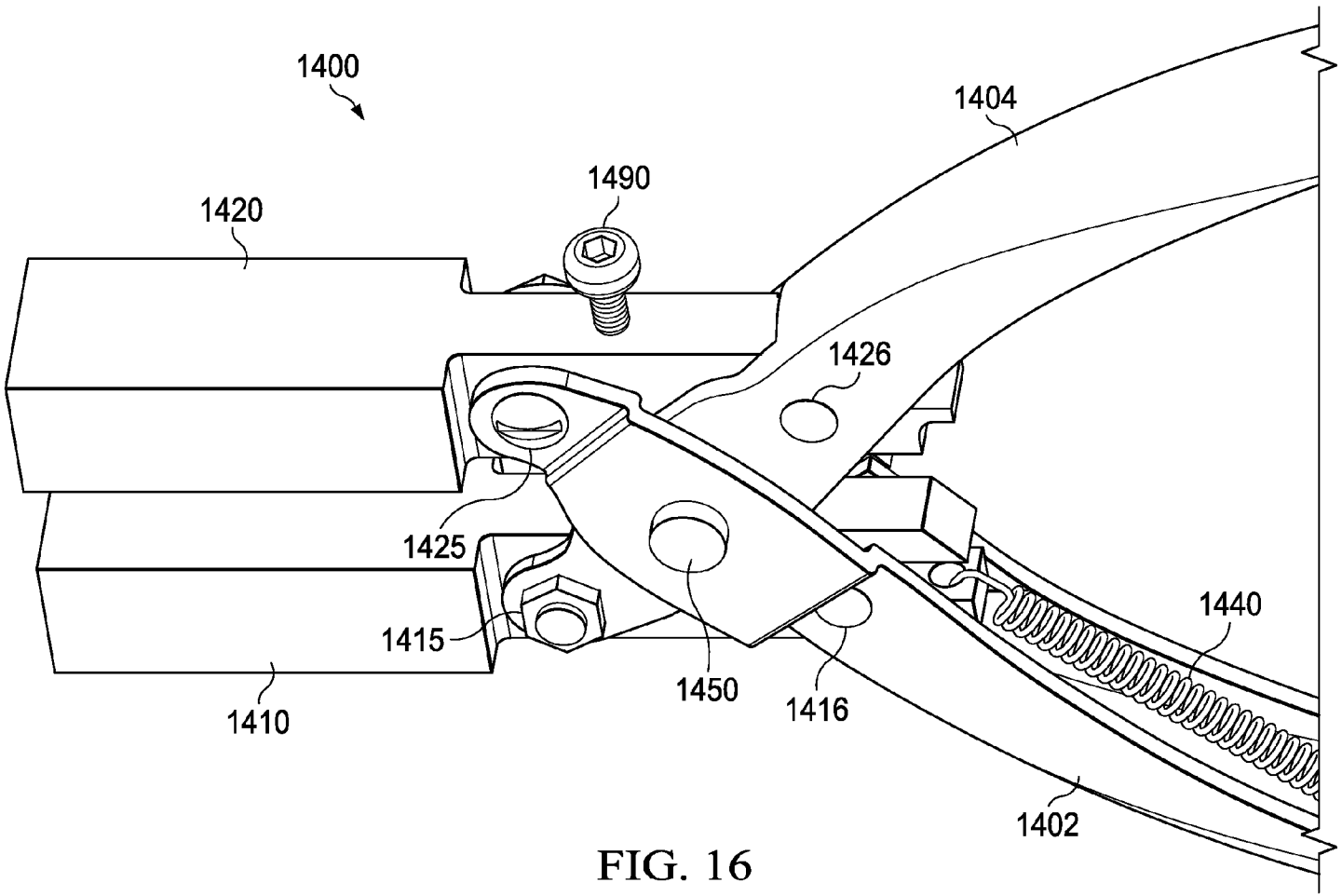
FIG. 16 is a perspective view of a pair of parallel-action mandrel pliers in accordance with an illustrative embodiment.

In the non-limiting embodiment in FIG. 14, each of the pair of handles 1402 and 1404 are shaped to define a trough that is bifurcated into a slot for the mandrel jaws 1410 and 1420 as discussed with regards to and as more clearly illustrated in FIG. 16. Housed at least partially within each trough is a spring that provides an opening force that causes the pair of parallel-action mandrel pliers 1400 to attain the open configuration upon release of the squeezing force on the pair of handles 1402 and 1404. In particular, spring 1460 is housed at least partially within the trough defined by handle 1404. A proximate end of the spring 1460 is attached to an anchor point (not shown) and the distal end of the spring 1460 is attached to the proximate end of the mandrel jaw 1420. Likewise, spring 1440 is housed at least partially within the trough defined by handle 1402 with a proximate end of the spring attached to another anchor (not shown) and a distal end of the spring 1440 attached to a proximate end of the mandrel jaw 1410. The proximate end of each mandrel jaw 1410 and 1420 rests on the rivets 1416 and 1426 that pass through one side of each handle 1402 and 1404 to the other side, to provide a surface on which the mandrel jaws 1410, 1420 can slide when the jaws are moved between the open and closed configuration. The rivets 1416, 1426 may also comprise rails housed between opposing sidewalls of the handles so as to provide the sliding surface for the mandrel jaws 1410, 1420.

Passing through one of the two mandrel jaws 1410 and 1420 is an adjustment screw 1490. In the present non-limiting embodiment, the adjustment screw 1490 passes through mandrel jaw 1420. The adjustment screw 1490 can keep the mandrel jaws 1410 and 1420 from closing past any particular width. The adjustment screw 1490 prevents the mandrel jaws 1410 and 1420 from closing any farther than the set width, and the screw 1490 can also prevent the mandrel jaws 1410 and 1420 from crushing the wires or the shape created by the wires or other material. Other types of détente mechanisms may be used to prevent the mandrel jaws 1410 and 1420 from closing any farther than a set width.

This non-limiting exemplary embodiment may be used in the same manner as disclosed with respect to FIGS. 3-7. This exemplary embodiment may be used by placing wire or any other material between the mandrel jaws 1410 and 1420 and wrapping the wire around the outside of either mandrel jaw while gripped firmly and pulling tightly on the wire. Then, once the wire is wrapped around the mandrel jaw, the mandrel jaw opens to allow for another iteration of wrapping the wire around the mandrel jaw. Also, as mentioned previously, the various mandrel jaw shapes may be used with the exemplary method so as to create different types of wire shapes.

An advantage of this non-limiting exemplary embodiment is that the parallel action provided by the mandrel pliers 1400 has a leveraging quality such that metal gripped by the pliers 1400 can be gripped much more tightly and securely while using less hand strength as compared to other types of pliers. Also, the metal can be gripped more tightly without marking or marring the metal by the pliers 1400.

Figure 15:
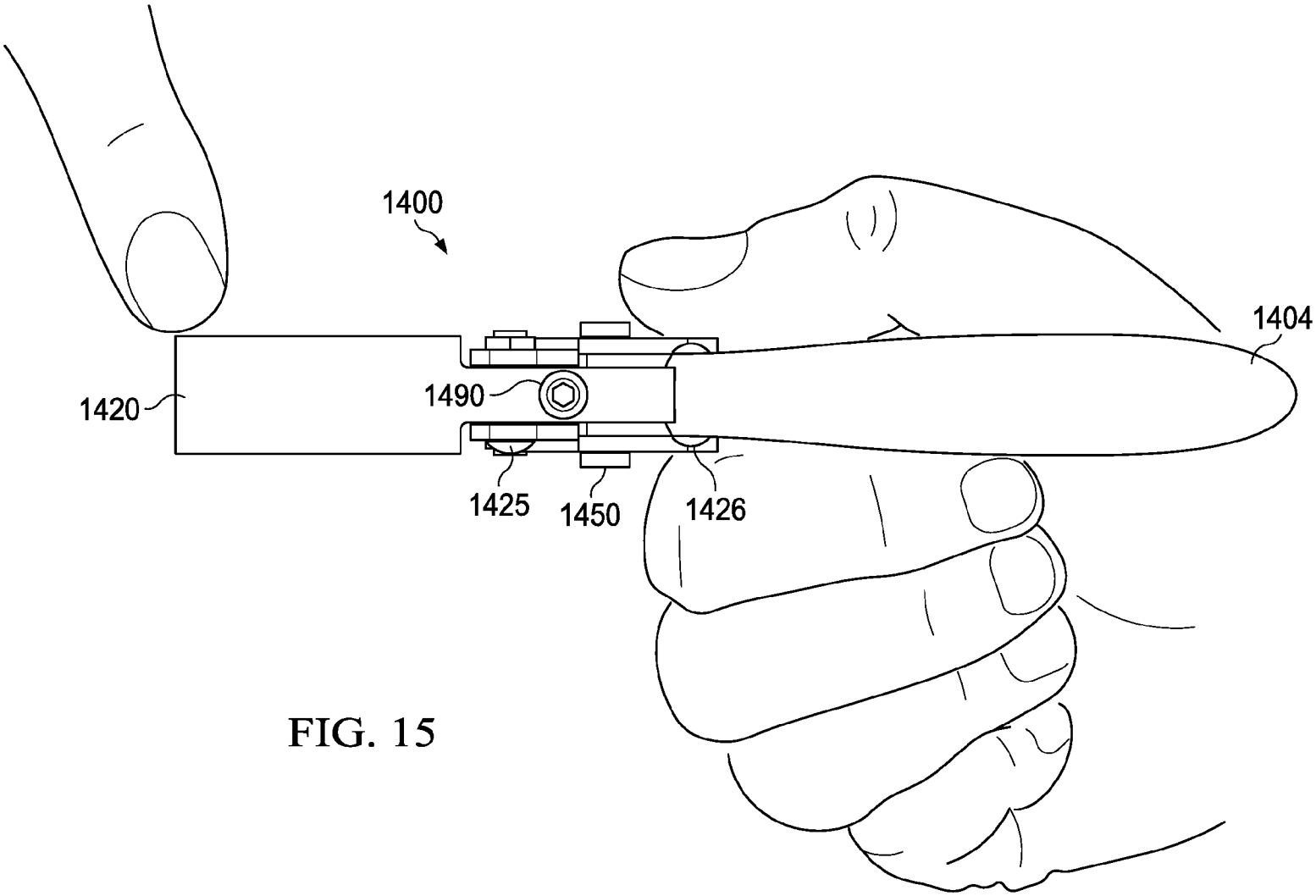
FIG. 15 is a top view of a pair of parallel-action mandrel pliers in accordance with an illustrative embodiment.

FIG. 15 is a top view of a pair of parallel-action mandrel pliers in accordance with an illustrative embodiment. FIG. 15 illustrates how the mandrel jaws 1410 and 1420 are coupled in relation to the handles 1402 and 1404. As shown previously with FIG. 14, pivot 1450 couples the handles 1402 and 1404 so as to give the pliers 1400 its pivoting motion, and the adjustment screw 1490 provides fine adjustment of the opening between the mandrel jaws 1410 and 1420. The handles 1402 and 1404 are shaped to extend past the pivot 1450 and connect to the mandrel jaws at screws 1415 and 1425. The screws 1415 and 1425 pass through the handles 1402 and 1404 as well as the corresponding mandrel jaw before a washer and nut is attached to the other side. The screws 1415 and 1425 may be polished, burnished, or otherwise smoothed out so as to not protrude out too much in relation to the width of the mandrel pliers 1400. Returning to FIG. 14, the handles 1402 and 1404 overlap each other to create a stable connection and an equal distribution of force when applied along the pivot 1450. On one side of the mandrel pliers 1400, handle 1404 overlaps handle 1402 at the pivot, and on the other side of the mandrel pliers 1400, handle 1402 overlaps handle 1404 at the pivot 1450. FIG. 15 also illustrates the width and shape of the mandrel jaw 1420 in comparison to the rest of the mandrel pliers 1400. Mandrel jaw 1410 is substantially the same as mandrel jaw 1420, as a top view of the mandrel pliers 1400 is substantially the same as a bottom view of the mandrel pliers 1400. In the present illustrative embodiment, the mandrel jaw 1420 comprises a rectangular prism shape, before the jaw 1420 tapers in shape and width for connecting the mandrel jaw 1420 to handle 1402 using the connecting screw 1425. The mandrel jaw 1420 maintains the smaller width from the point of connection with handle 1402 until the mandrel jaw 1420 tapers into a smaller width and shape, which is not shown in FIG. 15 and is illustrated more clearly with FIGS. 16, 17 and 19.

FIG. 16 is a perspective view of a pair of parallel-action mandrel pliers in accordance with an illustrative embodiment. The mandrel pliers 1400, as shown in FIG. 16, are in an open configuration with the handles 1402 and 1404 spread out. FIG. 16 illustrates how the handles 1402 and 1404 are coupled with the mandrel jaws 1410 and 1420. The mandrel jaws 1410 and 1420 extend into slots created by the bifurcations of each handle 1402 and 1404, and may extend out of the trough of the handles 1402 and 1404. Preferably, the mandrel jaws 1410 and 1420 extend a few millimeters past the handles 1402 and 1404.

Figure 17:
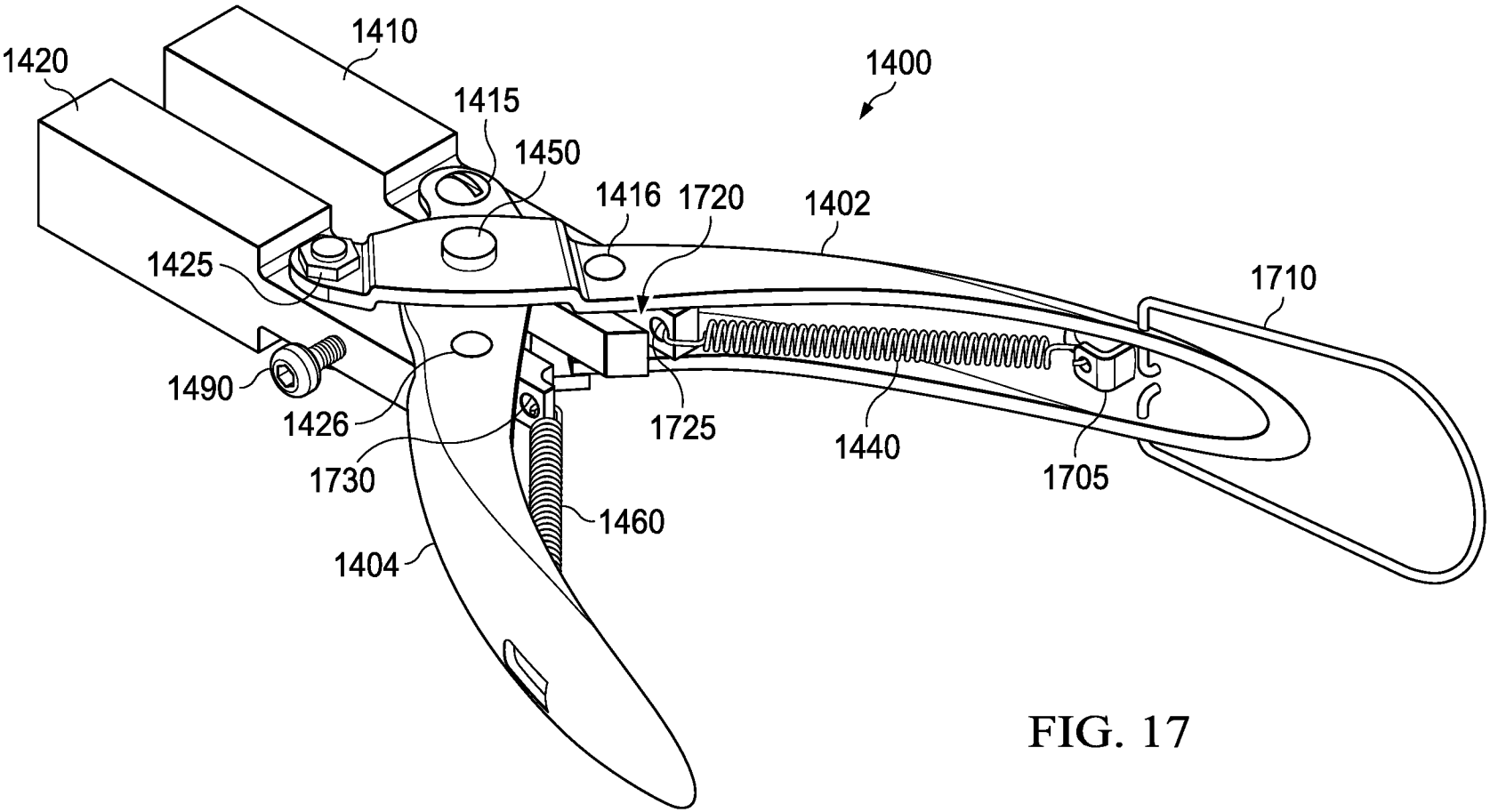
FIG. 17 is a perspective view of a pair of parallel-action mandrel pliers taken from a distal end in accordance with an illustrative embodiment.

FIG. 17 is a perspective view of a pair of parallel-action mandrel pliers taken from a distal end in accordance with an illustrative embodiment. FIG. 17 more clearly illustrates the trough of each handle 1402 and 1404, and the contents of the troughs. In the illustrative embodiment of FIG. 17, the troughs of the handles 1402 and 1404 at least partially houses springs 1440 and 1460. The proximate end of spring 1440 attaches to anchor 1705 on handle 1402, and similarly, the proximate end of spring 1460 attaches to a second anchor (not shown) on handle 1402. The positioning of the second anchor mirrors the positioning of the anchor 1705. The anchor 1705 may be a cut-out tab pushed into the trough of the handle 1402, so that the end of the spring 1440 hooks onto the anchor 1705.

FIG. 17 illustrates two alternative shapes of the proximate end of the mandrel jaws 1410 and 1420, and how the springs 1440 and 1460 attach to the two different end shapes of the mandrel jaws 1410 and 1420. The proximate end of mandrel jaw 1410 attached to spring 1440 comprises two protrusions created by a bifurcation of the proximate end of the mandrel jaw 1410 to form a slot 1720. The rivet 1416 is the structure that slides within the slot 1720 as the jaws 1410, 1420 are moving between the open and closed configurations. The spring 1440 can attach to a hole 1725 created on either of the two protrusions located at the proximate end of the mandrel jaw 1410.

For the other end shape, the proximate end of mandrel jaw 1420 attached to spring 1460 comprises an arcuate shape, and the spring 1460 is attached to an aperture 1730 located at the proximate end of mandrel jaw 1420. With this alternative end shape, the mandrel jaw 1420 has a reduced width on its proximal end so as to permit sliding on the surface of the rivet 1426 as the mandrel jaws move between the open and closed configurations. The reduced width of the mandrel jaw 1420 on its proximal end allows for the rivet to slide along the outside-facing surface of the mandrel jaw 1420, and the spring 1460 helps keep the mandrel jaw 1420 in contact with the rivet 1426 by applying pressure that pulls the mandrel jaw 1420 toward the handles 1402, 1404 and outward, thereby forcing the mandrel jaw 1420 to keep in contact with the rivet 1426. Alternatively, the proximate end of the mandrel jaw 1420 may comprise a flat angled shape, as illustrated with the first end shape of the mandrel jaw 1410, instead of an arcuate shape, as illustrated with the second end shape of the mandrel jaw 1420.

Also illustrated in FIG. 17 is a metal wire loop 1710 for securing the handles 1402 and 1404 together when the mandrel pliers 1400 are in a closed configuration. The metal wire loop 1710 is attached to a single handle 1404, and in other embodiments, the metal wire loop 1710 may be on the other handle 1402. When the mandrel pliers 1400 are in a closed configuration, the metal wire loop 1710 on handle 1404 may be pivoted and positioned so that the distal end of the metal wire loop 1710 loops around the distal end of handle 1402 before settling against the outer surface of the handle 1402. Therefore, when the force compressing the mandrel pliers 1400 into the closed configuration is released, the handle 1402 will pushed back against the metal wire loop 1710 and stay in either a closed configuration or a partially open configuration.

Figure 18:
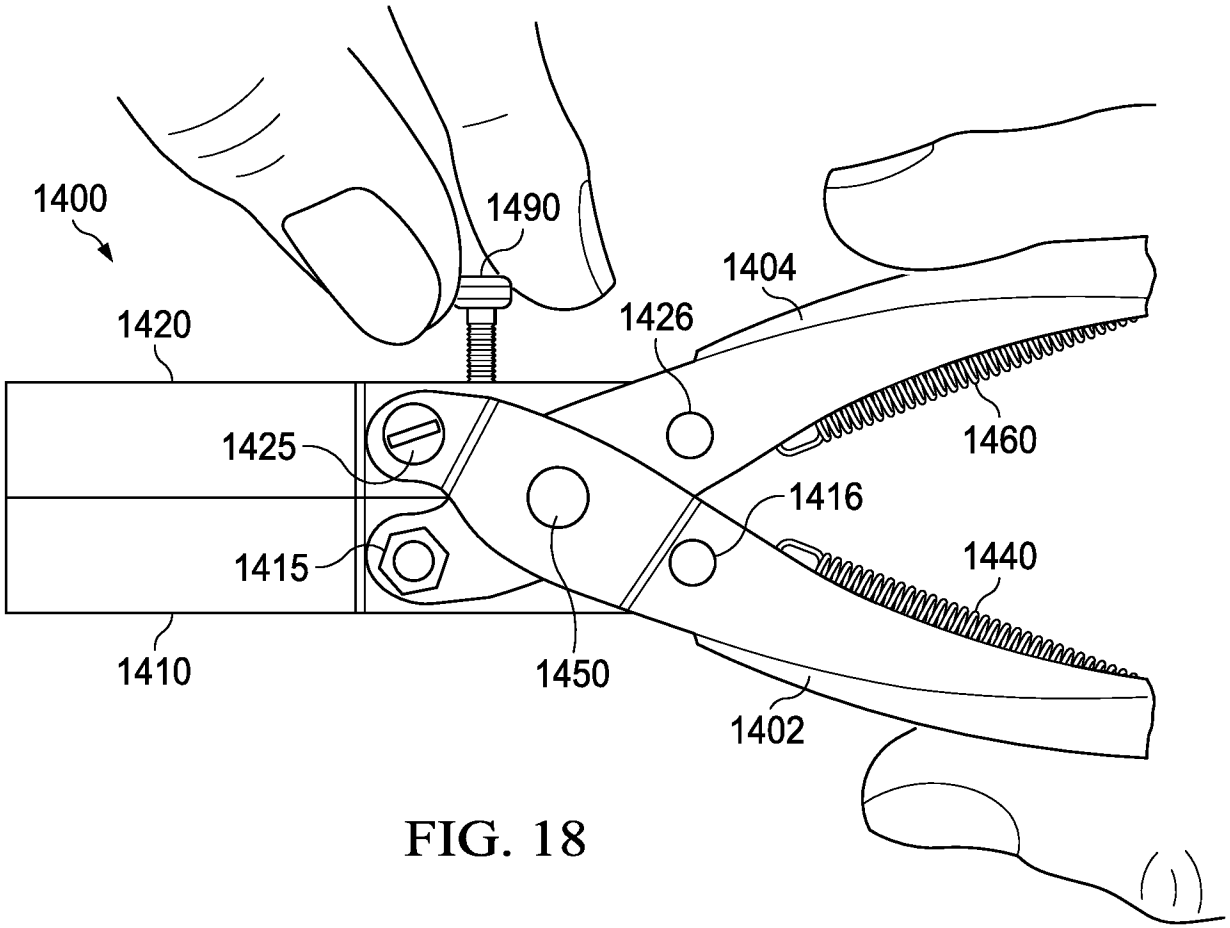
FIG. 18 is a side view of the pair of parallel-action mandrel pliers shown in FIG. 14 in a closed configuration and without the detent screw engaged.

FIG. 18 is a side view of the pair of parallel-action mandrel pliers shown in FIG. 14 in a closed configuration and without the adjustment screw engaged. As mentioned previously, the adjustment screw 1490 may be used to prevent the mandrel jaws 1410 and 1420 from closing any farther than a width prescribed by the adjustment screw 1490. As shown in FIG. 18, the adjustment screw is not engaged, and the adjustment screw 1490 is adjusted prior to applying force onto the handles 1402 and 1404 of the mandrel pliers 1400 into the closed configuration. In this closed configuration with the adjustment screw 1490 not engaged, the mandrel jaws 1410 and 1420 are able to completely close, such that the inner surfaces of the mandrel jaws 1410 and 1420 are in complete contact with each other.

Figure 19:
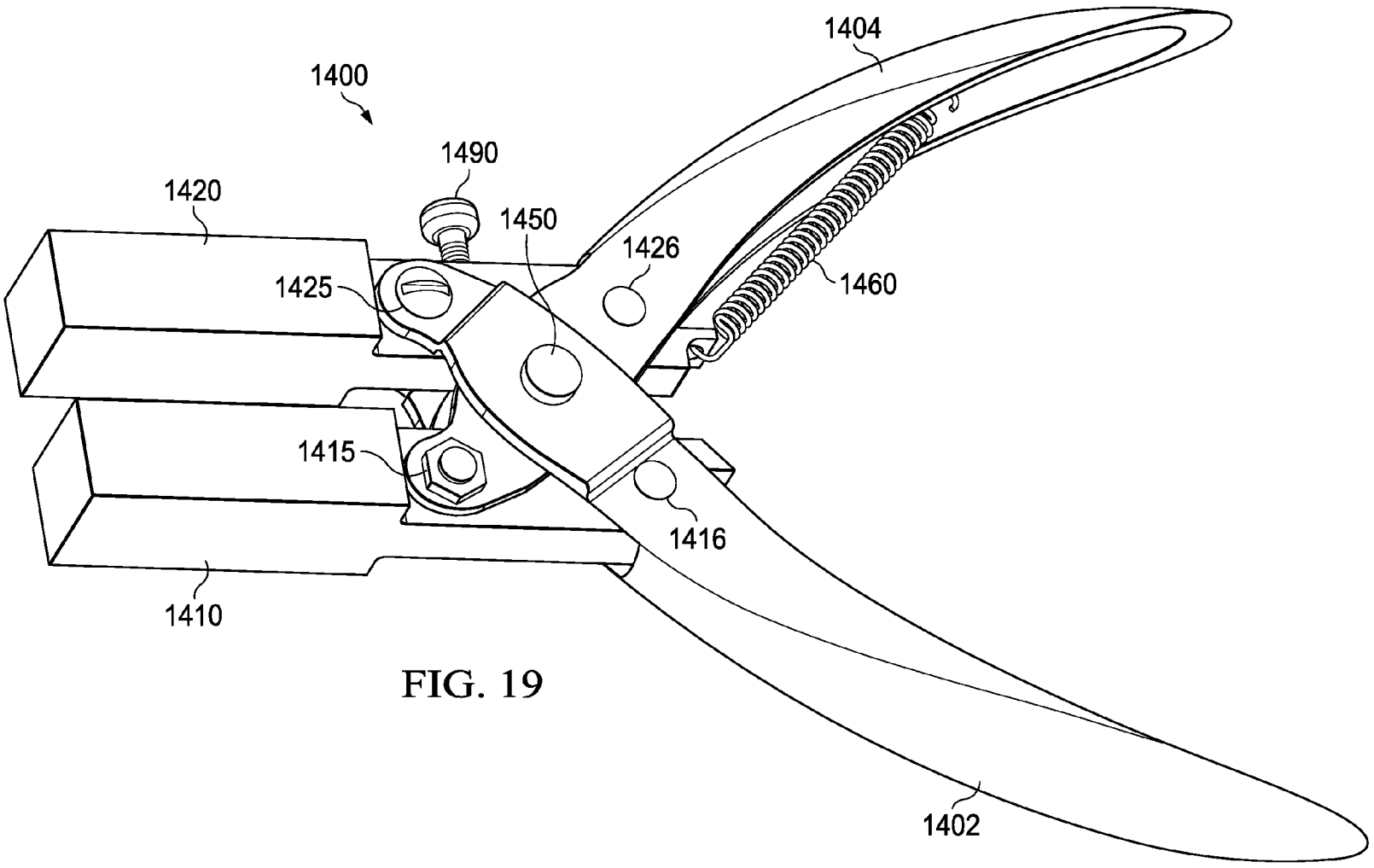
FIG. 19 is a perspective view of a pair of parallel-action mandrel pliers with the detent screw engaged.

FIG. 19 is a perspective view of a pair of parallel-action mandrel pliers with the adjustment screw engaged. The adjustment screw 1440 is engaged by tightening the screw 1490 and causing it to advance through the aperture so that it extends through the mandrel jaw 1420 toward the mandrel jaw 1410. The amount of tightening of the adjustment screw 1490 determines how large the gap is between the mandrel jaws 1410 and 1420 when the mandrel pliers 1400 are in the closed position.

Figure 20:
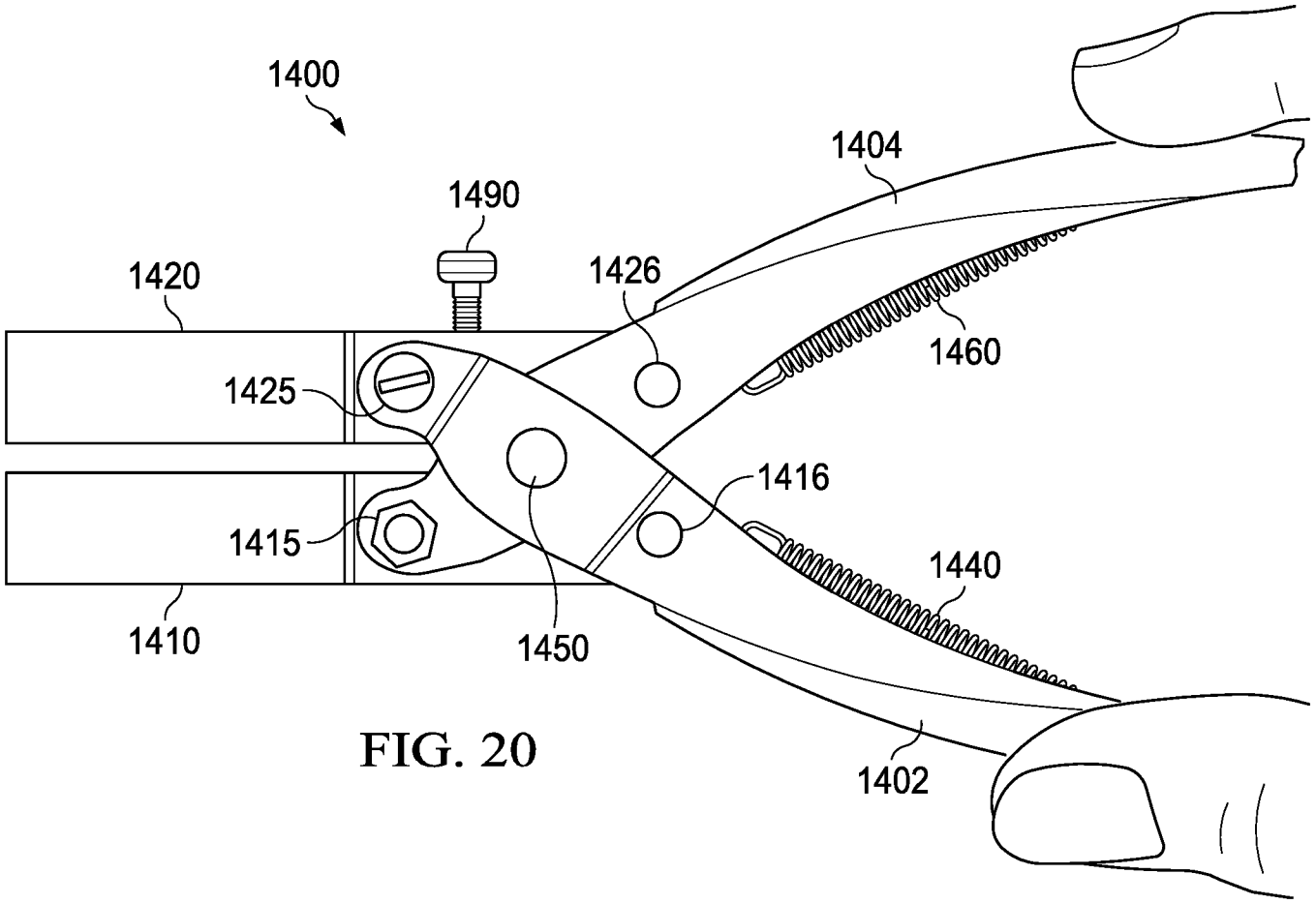
FIG. 20 is a side view of a pair of parallel-action mandrel pliers shown in FIG. 14 in a closed configuration with the adjustment screw engaged.

FIG. 20 is a side view of a pair of parallel-action mandrel pliers shown in FIG. 14 in a closed configuration with the adjustment screw engaged. As can be seen, the adjustment screw 1490 is engaged but it is not fully tightened into the adjustment screw aperture, and therefore, when the mandrel pliers 1400 are in the closed configuration, there is a gap between the mandrel jaws 1410 and 1420. The maximum gap between the mandrel jaws 1410 and 1420 depends on the adjustment screw 1490 used, and on the dimensions of the mandrel pliers 1400. The maximum gap between the mandrel jaws 1410 and 1420 is preferably smaller than the gap between the mandrel jaws when the mandrel pliers 1400 is in the open configuration.

The parallel-action mandrel pliers 1400 may also be used to crisp up any bends in the wire. For example, when a user makes square jump rings, the user wraps the wire around one of the mandrel jaws 1410, 1420 by hand, and each side of the square jump ring might have a slightly curved or rounded shape, especially when using a heavier gauge wire that is more difficult to manipulate by hand and when not employing the use of a hammer to tap the wire into shape on the mandrel jaw. After cutting the coil of jump rings apart, the user can flatten each side of the square jump ring by placing the ring back on one jaw of the pliers 1400 and applying the other mandrel jaw so as to apply pressure to flatten a particular side of the jump ring. The user can then remove the jump ring from the pliers 1400, rotate the square ring 180 degrees, put the square ring back on the mandrel jaw, and apply pressure via the other mandrel jaw. The user may also do the same with the other sides of the square jump ring to get a squared jump ring with flat sides. This technique is quicker than other conventional methods of crisping wire bends, such as hammering on the mandrel, and this technique may be used with the any size or shape, and combination thereof, of mandrel jaws.

In a non-limiting embodiment, the mandrel pliers 1400 may have mandrel jaws of different sizes. In this embodiment, the above disclosed technique of sharpening corners of jump rings may be more difficult when used with the larger mandrel jaw of the differently sized mandrel jaws because the smaller jaw does not extend the full width of the larger jaw and therefor limits the user's ability to sharpen or crisp the corners of a jump ring on the larger mandrel jaw with one compression of the mandrel jaws. Accordingly, the user may place the jump rings formed on the larger mandrel jaw onto the smaller mandrel jaw, and then align the corner of the jump ring snugly against the edge of the smaller jaw. By doing this, the user can then flatten the area of the side of the jump ring that is between the mandrel jaws, and this area may include the side of the jump ring up to the corner of the jump ring. Then, the user can slide the jump ring along the mandrel jaw so that the adjacent corner is pressed against the opposite side of the smaller mandrel, and then the user can then apply pressure so as to flatten the area around the adjacent corner of the jump ring. This technique may be then repeated for any of the other sides of the jump ring.

While the above technique may be used with parallel-action mandrel pliers with jaws of different sizes, crisping wire bends may be more efficient with parallel-action mandrel pliers with same size jaws. Alternatively, mandrel jaws with different shapes having the side that meets the other mandrel jaw the same width as each other may allow for a variety of different shapes and sizes to be formed while maintaining the ability to crisp the wire corners or any other wire bends. Additionally, the above techniques may be used with both open jump rings and closed (soldered) jump rings.

FIGS. 14-20 illustrates an exemplary embodiment of a pair of parallel-action mandrel pliers. The exemplary embodiment may be used with any of the previous exemplary embodiments shown in FIGS. 1-13.

The tool and method of the present invention thus provides an efficient and consistent method for a jeweler to make shapes using mandrels. When making shapes with sharp corners it is no longer necessary to join a loop together and form it by hammering it on a tapered mandrel. Because the loop can be left opened, the shapes can be more easily joined directly to each other before soldering them closed. A step is saved and finishing is easier because the jeweler does not have to cut the shape open and then re-solder. In addition, there are applications for open shapes to be used where it is not necessary to solder it closed, in which case, the step of cutting the formed link is saved.

The jeweler can make square, oval, circular, triangular, rectangular and other shapes in multiples rather than one at a time as is required when using a tapered mandrel. The jeweler can also maintain a consistent circumference of the shaped piece without having to flip the piece over repetitively as is required when working wired pieces of material on a tapered mandrel. A vise is no longer necessary because the jeweler can easily grip the material by hand using the mandrel pliers. The mandrel pliers allow the jeweler a good view of both the front and the back of the piece by changing the position of the handle on the pliers as the material is being worked. This makes it possible to wrap perfect coil in various shapes as desired by a jeweler.

Although the invention is described above and in the drawings using mandrel jaws of the same shapes, square, circular, etc., the invention is not limited to jaws of the same shape. For example, one jaw could be a square shape and the other rectangular. One could be triangular and the other circular. The mandrel jaws can also be chosen such that special shapes like hearts or teardrops can be formed. One jaw could be of a "v" or triangular shape that mates with an opposing heart shaped jaw to allow the formation of a crisp "v" or cleft in the top of the heart. Alternatively, one jaw could be of a "v" shape that mates with the bottom of the teardrop on a teardrop shaped opposing jaw. Numerous other shapes could also be formed with the mandrel pliers of the present invention by using various shapes on the jaws of the pliers.

Although the invention hereof has been described by way of a preferred embodiment, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention. For example, the shapes of the mandrel jaws could be any shape desired by the jeweler, including non-traditional shapes.

What is claimed is:

1. A pair of mandrel pliers for forming a material during the manufacture of jewelry, the pair of mandrel pliers comprising:

a first member forming a first handle, wherein the first member has a first proximate end and a first distal end;

a second member forming a second handle, wherein the second member has a second proximate end and a second distal end, and wherein the first member and the second member are pivotably joined at a central connection point;

a first mandrel jaw pivotably fastened to the first member at the first distal end, and wherein the first mandrel jaw is slidably engaged to a second rail housed between opposing sidewalls of the second member at a position between the second proximate end and the second distal end;

a second mandrel jaw pivotably fastened to the second member at the second distal end, and wherein the second mandrel jaw is slidably engaged to a first rail housed between opposing sidewalls of the first member at a position between the first proximate end and the first distal end; and wherein the first mandrel jaw and the second mandrel jaw are capable of securely gripping the material at a location between the first mandrel jaw and the second mandrel jaw upon an application of a squeezing force to the first handle and the second handle, and wherein the first mandrel jaw and the second mandrel jaw are parallel to each other upon the application of the squeezing force the pair of mandrel pliers further comprising an adjustment screw that controls a width of a gap between the first mandrel jaw and the second mandrel jaw when the mandrel pliers are in a closed configuration.

2. The pair of mandrel pliers of claim 1, wherein the first member further comprises a first bifurcation at the first distal end, and wherein an elongate body of the first member is shaped to define a first trough, and wherein the second member further comprises a second bifurcation at the second distal end, and wherein an elongate body of the second member is shaped to define a second trough.

3. The pair of mandrel pliers of claim 2, wherein the first mandrel jaw is suspended between the first bifurcation and the second bifurcation, and wherein the second mandrel jaw is suspended between the second bifurcation and the first bifurcation.

4. The pair of mandrel pliers of claim 2, further comprising:

a first spring housed at least partially within the first trough of the first member, wherein a first end of the first spring is anchored to a first position closer to the first proximate end of the first member than the first distal end of the first member, and wherein a second end of the first spring is anchored to a proximate end of the second mandrel jaw; and a second spring housed at least partially within the second trough of the second member, wherein a first end of the second spring is anchored to a second position closer to the second proximate end of the second member than the second distal end of the second member, and wherein a second end of the second spring is anchored to a proximate end of the first mandrel jaw.

5. The mandrel pliers of claim 1, wherein a first cross-sectional area of the first mandrel jaw is rectangular, or a second cross-sectional area of the second mandrel jaw is rectangular, or both the first cross-sectional area and the second cross-sectional area are rectangular.

6. The mandrel pliers of claim 1, wherein a first cross-sectional area of the first mandrel jaw is triangular, or a second cross-sectional area of the second mandrel jaw is triangular, or both the first cross-sectional area and the second cross-sectional area are triangular.

7. The mandrel pliers of claim 1, wherein a first cross-sectional area of the first mandrel jaw is oval, or said second cross-sectional area of the second mandrel jaw is oval, or both the first cross-sectional area and the second cross-sectional area are.

8. The mandrel pliers of claim 1, wherein a first cross sectional area of the first mandrel jaw is circular, or a second cross-sectional area of the second mandrel jaw is circular, or both the first cross-sectional area and the second cross-sectional area are circular.

9. The mandrel pliers of claim 1, wherein wrapping said material around said first mandrel jaw at said location forms a first loop enclosing a first area, and wherein wrapping said material around said second mandrel jaw at said location forms a second loop enclosing a second area different than said first area.

10. A method for forming a material using a pair of mandrel pliers, wherein the pair of mandrel pliers comprise a first member forming a first handle, wherein the first member has a first proximate end and a first distal end;

a second member forming a second handle, wherein the second member has a second proximate end and a second distal end, and wherein the first member and the second member are pivotably joined at a central connection point;

a first mandrel jaw pivotably fastened to the first member at the first distal end, and wherein the first mandrel jaw is slidably engaged to a second rail housed between opposing sidewalls of the second member at a position between the second proximate end and the second distal end;

a second mandrel jaw pivotably fastened to the second member at the second distal end, and wherein the second mandrel jaw is slidably engaged to a first rail housed between opposing sidewalls of the first member at a position between the first proximate end and the first distal end; and wherein the first mandrel jaw and the second mandrel jaw are capable of securely gripping the material at a location between the first mandrel jaw and the second mandrel jaw upon an application of a squeezing force to the first handle and the second handle, and wherein the first mandrel jaw and the second mandrel jaw are parallel to each other upon the application of the squeezing force, said method comprising:

placing said material at a location between said first mandrel jaw and said second mandrel jaw, wherein the location is also within a first operable length of the first mandrel jaw and a second operable length of the second mandrel jaw;

applying a squeezing force to said first handle and said second handle to securely grip the material at the location between said first mandrel jaw and said second mandrel jaw;

pulling on said material while wrapping said material at least partially around said first mandrel jaw to form a first loop at least partially enclosing a first area, or pulling on said material while wrapping said material at least partially around said second mandrel jaw to form a second loop at least partially enclosing a second area different than said first area.

11. The method of claim 10 further comprising:

releasing said squeezing force to separate said first mandrel jaw and said second mandrel jaw;

continuing to wrap the material around either said first mandrel jaw or said second mandrel jaw to complete said first loop or said second loop.

12. The method of claim 11, further comprising:

repeating the steps of the method to form a plurality of loops.

13. The method of claim 11, further comprising:

hammering said first loop or said second loop to sharpen corners of said first loop or said second loop.

14. The method of claim 10, wherein said first area comprises one of a rectangular shape, a triangular shape, an oval shape, and a circular shape.

15. The method of claim 10, wherein the second area comprises one of a rectangular shape, a triangular shape, an oval shape, and a circular shape.

16. The method of claim 10, wherein the first member further comprises a first bifurcation at the distal end, and wherein an elongate body of the first member is shaped to define a first trough, and wherein the second member further comprises a second bifurcation at the distal end, and wherein an elongate body of the second member is shaped to define a second trough.

17. The method of claim 16, wherein the first mandrel jaw is suspended between the first bifurcation and the second bifurcation, and wherein the second mandrel jaw is suspended between the second bifurcation and the first bifurcation.

18. The method of claim 16, wherein the pair of mandrel pliers further comprises:

a first spring housed at least partially within the first trough of the first member, wherein a first end of the first spring is anchored to a first position closer to the first proximate end of the first member than the first distal end of the first member, and wherein a second end of the first spring is anchored to a proximate end of the second mandrel jaw; and a second spring housed at least partially within the second trough of the second member, wherein a first end the second spring is anchored to a second position closer to the second proximate end of the second member than the second distal end of the second member, and wherein a second end of the second spring is anchored to a proximate end of the first mandrel jaw.

19. The method of claim 10, further comprising an adjustment screw for controlling a width of a gap between the first mandrel jaw and the second mandrel jaw when the mandrel pliers are in a closed configuration.

20. A pair of mandrel pliers for forming a material during the manufacture of jewelry, the pair of mandrel pliers comprising:

a first member forming a first handle, wherein the first member has a first proximate end and a first distal end;

a second member forming a second handle, wherein the second member has a second proximate end and a second distal end, and wherein the first member and the second member are pivotably joined at a central connection point;

a first mandrel jaw pivotably fastened to the first member at the first distal end, and wherein the first mandrel jaw is slidably engaged to a second rail housed between opposing sidewalls of the second member at a position between the second proximate end and the second distal end;

a second mandrel jaw pivotably fastened to the second member at the second distal end, and wherein the second mandrel jaw is slidably engaged to a first rail housed between opposing sidewalls of the first member at a position between the first proximate end and the first distal end; and wherein the first mandrel jaw and the second mandrel jaw are capable of securely gripping the material at a location between the first mandrel jaw and the second mandrel jaw upon an application of a squeezing force to the first handle and the second handle, and wherein the first mandrel jaw and the second mandrel jaw are parallel to each other upon the application of the squeezing force;

wherein the first member further comprises a first bifurcation at the first distal end, and wherein an elongate body of the first member is shaped to define a first trough, and wherein the second member further comprises a second bifurcation at the second distal end, and wherein an elongate body of the second member is shaped to define a second trough;

the pair of mandrel pliers further comprising:

a first spring housed at least partially within the first trough of the first member, wherein a first end of the first spring is anchored to a first position closer to the first proximate end of the first member than the first distal end of the first member, and wherein a second end of the first spring is anchored to a proximate end of the second mandrel jaw; and a second spring housed at least partially within the second trough of the second member, wherein a first end of the second spring is anchored to a second position closer to the second proximate end of the second member than the second distal end of the second member, and wherein a second end of the second spring is anchored to a proximate end of the first mandrel jaw.

21. The pair of mandrel pliers of claim 20, wherein the first mandrel jaw is suspended between the first bifurcation and the second bifurcation, and wherein the second mandrel jaw is suspended between the second bifurcation and the first bifurcation.

22. The mandrel pliers of claim 20, wherein a first cross-sectional area of the first mandrel jaw is rectangular, or a second cross-sectional area of the second mandrel jaw is rectangular, or both the first cross-sectional area and the second cross-sectional area are rectangular.

23. The mandrel pliers of claim 20, wherein a first cross-sectional area of the first mandrel jaw is triangular, or a second cross-sectional area of the second mandrel jaw is triangular, or both the first cross-sectional area and the second cross-sectional area are triangular.

24. The mandrel pliers of claim 20, wherein a first cross-sectional area of the first mandrel jaw is oval, or said second cross-sectional area of the second mandrel jaw is oval, or both the first cross-sectional area and the second cross-sectional area are oval.

25. The mandrel pliers of claim 20, wherein a first cross sectional area of the first mandrel jaw is circular, or a second cross-sectional area of the second mandrel jaw is circular, or both the first cross-sectional area and the second cross-sectional area are circular.

26. The mandrel pliers of claim 20, wherein wrapping said material around said first mandrel jaw at said location forms a first loop enclosing a first area, and wherein wrapping said material around said second mandrel jaw at said location forms a second loop enclosing a second area different than said first area.

27. A pair of mandrel pliers for forming a material during the manufacture of jewelry, the pair of mandrel pliers comprising:

a first member forming a first handle, wherein the first member has a first proximate end and a first distal end;

a second member forming a second handle, wherein the second member has a second proximate end and a second distal end, and wherein the first member and the second member are pivotably joined at a central connection point;

a first mandrel jaw pivotably fastened to the first member at the first distal end, and wherein the first mandrel jaw is slidably engaged to a second rail housed between opposing sidewalls of the second member at a position between the second proximate end and the second distal end;

a second mandrel jaw pivotably fastened to the second member at the second distal end, and wherein the second mandrel jaw is slidably engaged to a first rail housed between opposing sidewalls of the first member at a position between the first proximate end and the first distal end; and wherein the first mandrel jaw and the second mandrel jaw are capable of securely gripping the material at a location between the first mandrel jaw and the second mandrel jaw upon an application of a squeezing force to the first handle and the second handle, and wherein the first mandrel jaw and the second mandrel jaw are parallel to each other upon the application of the squeezing force;

wherein a first cross-sectional area of the first mandrel jaw is rectangular, or a second cross-sectional area of the second mandrel jaw is rectangular, or both the first cross-sectional area and the second cross-sectional area are rectangular.

28. The pair of mandrel pliers of claim 27 wherein the first member further comprises a first bifurcation at the first distal end, and wherein an elongate body of the first member is shaped to define a first trough, and wherein the second member further comprises a second bifurcation at the second distal end, and wherein an elongate body of the second member is shaped to define a second trough.

29. The pair of mandrel pliers of claim 28 wherein the first mandrel jaw is suspended between the first bifurcation and the second bifurcation, and wherein the second mandrel jaw is suspended between the second bifurcation and the first bifurcation.

30. The pair of mandrel pliers of claim 28 further comprising:

a first spring housed at least partially within the first trough of the first member, wherein a first end of the first spring is anchored to a first position closer to the first proximate end of the first member than the first distal end of the first member, and wherein a second end of the first spring is anchored to a proximate end of the second mandrel jaw; and a second spring housed at least partially within the second trough of the second member, wherein a first end of the second spring is anchored to a second position closer to the second proximate end of the second member than the second distal end of the second member, and wherein a second end of the second spring is anchored to a proximate end of the first mandrel jaw.

31. The mandrel pliers of claim 27, wherein wrapping said material around said first mandrel jaw at said location forms a first loop enclosing a first area, and wherein wrapping said material around said second mandrel jaw at said location forms a second loop enclosing a second area different than said first area.

32. The mandrel pliers of claim 27 further comprising an adjustment screw that controls a width of a gap between the first mandrel jaw and the second mandrel jaw when the mandrel pliers are in a closed configuration.

33. A pair of mandrel pliers for forming a material during the manufacture of jewelry, the pair of mandrel pliers comprising:

a first member forming a first handle, wherein the first member has a first proximate end and a first distal end;

a second member forming a second handle, wherein the second member has a second proximate end and a second distal end, and wherein the first member and the second member are pivotably joined at a central connection point;

a first mandrel jaw pivotably fastened to the first member at the first distal end, and wherein the first mandrel jaw is slidably engaged to a second rail housed between opposing sidewalls of the second member at a position between the second proximate end and the second distal end;

a second mandrel jaw pivotably fastened to the second member at the second distal end, and wherein the second mandrel jaw is slidably engaged to a first rail housed between opposing sidewalls of the first member at a position between the first proximate end and the first distal end; and wherein the first mandrel jaw and the second mandrel jaw are capable of securely gripping the material at a location between the first mandrel jaw and the second mandrel jaw upon an application of a squeezing force to the first handle and the second handle, and wherein the first mandrel jaw and the second mandrel jaw are parallel to each other upon the application of the squeezing force;

wherein a first cross-sectional area of the first mandrel jaw is triangular, or a second cross-sectional area of the second mandrel jaw is triangular, or both the first cross-sectional area and the second cross-sectional area are triangular.

34. The pair of mandrel pliers of claim 33 wherein the first member further comprises a first bifurcation at the first distal end, and wherein an elongate body of the first member is shaped to define a first trough, and wherein the second member further comprises a second bifurcation at the second distal end, and wherein an elongate body of the second member is shaped to define a second trough.

35. The pair of mandrel pliers of claim 34 wherein the first mandrel jaw is suspended between the first bifurcation and the second bifurcation, and wherein the second mandrel jaw is suspended between the second bifurcation and the first bifurcation.

36. The pair of mandrel pliers of claim 34 further comprising:

a first spring housed at least partially within the first trough of the first member, wherein a first end of the first spring is anchored to a first position closer to the first proximate end of the first member than the first distal end of the first member, and wherein a second end of the first spring is anchored to a proximate end of the second mandrel jaw; and a second spring housed at least partially within the second trough of the second member, wherein a first end of the second spring is anchored to a second position closer to the second proximate end of the second member than the second distal end of the second member, and wherein a second end of the second spring is anchored to a proximate end of the first mandrel jaw.

37. The mandrel pliers of claim 33 wherein wrapping said material around said first mandrel jaw at said location forms a first loop enclosing a first area, and wherein wrapping said material around said second mandrel jaw at said location forms a second loop enclosing a second area different than said first area.

38. The mandrel pliers of claim 33 further comprising an adjustment screw that controls a width of a gap between the first mandrel jaw and the second mandrel jaw when the mandrel pliers are in a closed configuration.

39. A pair of mandrel pliers for forming a material during the manufacture of jewelry, the pair of mandrel pliers comprising:

a first member forming a first handle, wherein the first member has a first proximate end and a first distal end;

a second member forming a second handle, wherein the second member has a second proximate end and a second distal end, and wherein the first member and the second member are pivotably joined at a central connection point;

a first mandrel jaw pivotably fastened to the first member at the first distal end, and wherein the first mandrel jaw is slidably engaged to a second rail housed between opposing sidewalls of the second member at a position between the second proximate end and the second distal end;

a second mandrel jaw pivotably fastened to the second member at the second distal end, and wherein the second mandrel jaw is slidably engaged to a first rail housed between opposing sidewalls of the first member at a position between the first proximate end and the first distal end; and wherein the first mandrel jaw and the second mandrel jaw are capable of securely gripping the material at a location between the first mandrel jaw and the second mandrel jaw upon an application of a squeezing force to the first handle and the second handle, and wherein the first mandrel jaw and the second mandrel jaw are parallel to each other upon the application of the squeezing force;

wherein a first cross-sectional area of the first mandrel jaw is oval, or said second cross-sectional area of the second mandrel jaw is oval, or both the first cross-sectional area and the second cross-sectional area are oval.

40. The pair of mandrel pliers of claim 39 wherein the first member further comprises a first bifurcation at the first distal end, and wherein an elongate body of the first member is shaped to define a first trough, and wherein the second member further comprises a second bifurcation at the second distal end, and wherein an elongate body of the second member is shaped to define a second trough.

41. The pair of mandrel pliers of claim 40 wherein the first mandrel jaw is suspended between the first bifurcation and the second bifurcation, and wherein the second mandrel jaw is suspended between the second bifurcation and the first bifurcation.

42. The pair of mandrel pliers of claim 40 further comprising:

a first spring housed at least partially within the first trough of the first member, wherein a first end of the first spring is anchored to a first position closer to the first proximate end of the first member than the first distal end of the first member, and wherein a second end of the first spring is anchored to a proximate end of the second mandrel jaw; and a second spring housed at least partially within the second trough of the second member, wherein a first end of the second spring is anchored to a second position closer to the second proximate end of the second member than the second distal end of the second member, and wherein a second end of the second spring is anchored to a proximate end of the first mandrel jaw.

43. The mandrel pliers of claim 39 wherein wrapping said material around said first mandrel jaw at said location forms a first loop enclosing a first area, and wherein wrapping said material around said second mandrel jaw at said location forms a second loop enclosing a second area different than said first area.

44. The mandrel pliers of claim 39 further comprising an adjustment screw that controls a width of a gap between the first mandrel jaw and the second mandrel jaw when the mandrel pliers are in a closed configuration.

* * * * *